US008485854B2

(12) United States Patent
Gallato et al.

(10) Patent No.: US 8,485,854 B2
(45) Date of Patent: Jul. 16, 2013

(54) SHIP DRIVE COMPRISING A DRIVE UNIT THAT CAN BE PIVOTED UNDER WATER

(75) Inventors: Fernando Gallato, Padua (IT); Paolo Cattapan, Padua (IT); Andrea Tognon, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 133 days.

(21) Appl. No.: 13/145,610

(22) PCT Filed: Feb. 11, 2010

(86) PCT No.: PCT/EP2010/051702

§ 371 (c)(1),
(2), (4) Date: Jul. 21, 2011

(87) PCT Pub. No.: WO2010/094615

PCT Pub. Date: Aug. 26, 2010

(65) Prior Publication Data

US 2012/0028520 A1 Feb. 2, 2012

(30) Foreign Application Priority Data

Feb. 18, 2009 (DE) ..... 10 2009 000 995

(51) Int. Cl.
*B63H 20/00* (2006.01)

(52) U.S. Cl.
USPC ..... 440/88 L

(58) Field of Classification Search
USPC ..... 440/88 L
See application file for complete search history.

(56) References Cited

U.S. PATENT DOCUMENTS

| | | | | |
|---|---|---|---|---|
| 3,931,783 | A | 1/1976 | Croisant | |
| 5,236,380 | A | 8/1993 | Schueller et al. | |
| 5,284,223 | A * | 2/1994 | Fisher | 184/6.4 |
| 6,478,646 | B1 | 11/2002 | Fukuoka et al. | |
| 6,695,659 | B2 | 2/2004 | Kolb et al. | |
| 7,117,976 | B2 * | 10/2006 | Rowe et al. | 184/6.28 |
| 7,850,496 | B1 * | 12/2010 | Eichinger | 440/88 L |
| 2005/0118900 | A1 | 6/2005 | Takahashi et al. | |

FOREIGN PATENT DOCUMENTS

| | | |
|---|---|---|
| DE | 73 207 | 5/1970 |
| DE | 699 33 288 T2 | 4/2007 |
| EP | 1 078 850 B1 | 9/2006 |
| WO | 2008/136712 A1 | 11/2008 |

* cited by examiner

*Primary Examiner* — Stephen Avila
(74) *Attorney, Agent, or Firm* — Davis & Bujold, PLLC

(57) ABSTRACT

A ship drive with upper and lower drive units that are respectively arranged inside and outside the hull. At least the lower drive unit is pivotally mounted relative to the hull. An input shaft of the upper drive unit is driven by a motor. At least one propeller is driven by an output shaft of the lower drive unit. A vertical drive shaft communicates, via an upper bevel gearing, with the input shaft of the upper drive unit and, via a lower bevel gearing, with the output shaft of the lower drive unit. The upper and lower drive units comprise interconnected lubrication oil ducts by which lubrication oil is supply to and remove from the upper drive unit. At least one lubrication oil duct of the upper drive unit is connected, by a flexible line, to a lubrication oil container arranged in the area of the upper drive unit.

15 Claims, 2 Drawing Sheets

SHIP DRIVE COMPRISING A DRIVE UNIT THAT CAN BE PIVOTED UNDER WATER

This application is a National Stage completion of PCT/EP2010/051702 filed Feb. 11, 2010, which claims priority from German patent application serial no. 10 2009 000 995.7 filed Feb. 18, 2009.

FIELD OF THE INVENTION

The invention concerns a ship drive.

BACKGROUND OF THE INVENTION

From DE 699 33 288 T2 (EP 1 078 850 B1), which defines the type of drive concerned, a ship's drive is known, which comprises an upper drive unit arranged in the ship's hull and a lower drive unit arranged outside the ship's hull, in which at least the lower drive unit is mounted so that it can pivot relative to the ship's hull, an input shaft of the upper drive unit can be driven by a drive motor, a propeller can be driven by an output shaft arranged in the lower drive unit, a vertically arranged driveshaft is in driving connection, via upper bevel gearing, with the input shaft of the upper drive unit and, via lower bevel gearing, with the output shaft of the lower drive unit, and the upper and lower drive units comprise interconnected lubrication oil ducts such that the lubrication oil can be fed into the upper drive unit and also removed through it.

A ship drive of this design has the advantage that it can be filled and drained with lubrication oil from inside the hull of the ship. Accordingly, in contrast to other ship drives oil changes no longer have to take place in a dry-dock with the associated costs. Yet, there is still a need to improve this ship drive further. This relates in particular to design measures concerning the storage of lubrication oil and to the structure of the spaces and ducts that carry the lubrication oil in the ship drive.

SUMMARY OF THE INVENTION

Thus, the purpose of the invention is to develop further a ship drive of the type concerned in such manner that lubrication oil can be fed in and drained out in a simple way, for example when filling it for the first time or for an oil change. In addition simple and mechanically reliable means should be provided for feeding in and storing the oil, in particular ones which durably withstand the loads imposed by vibrations of the ship and its drive system. Furthermore venting should be possible so that when lubrication oil is being filled in, air can escape from the oil-carrying spaces. Finally, the ship's drive should be designed so that the lubrication oil can undergo temperature-related volume changes without inadvertently escaping from the ship's drive or causing other damage.

At least one of these objectives is achieved by the characteristics specified in the principal claim, while advantageous further developments and design features emerge from the subordinate claims.

Accordingly, the starting point for the invention is a ship's drive with an upper drive unit arranged in the ship's hull and a lower drive unit arranged outside the ship's hull, in which at least the lower drive unit is mounted to rotate or pivot relative to the ship's hull, in which an input shaft of the upper drive unit can be driven by a drive motor, in which at least one propeller can be driven by an output shaft arranged in the lower drive unit, in which a vertically arranged driveshaft is in driving connection, via an upper bevel gear, with the input shaft of the upper drive unit, and, via lower bevel gear, with the output shaft of the lower drive unit, and in which the upper and lower drive units comprise interconnected lubrication oil ducts such that the lubrication oil can be fed into the upper drive unit and also drained away therefrom. In addition it is provided that at least one lubrication oil duct of the upper drive unit is connected, via a flexible line, to a lubrication oil container arranged in the area of the upper drive unit.

According to another design it is provided that the at least one lubrication oil container is arranged a distance away from the upper bevel gear or its gearbox. The effect of this measure is that vibrations from the ship drive cannot directly reach the at least one lubrication oil container.

To enable the lubrication oil level in the at least one lubrication oil container to be determined simply and at any time, it can also be provided that the housing of the lubrication oil container is at least partially transparent. The transparency of the housing also enables the crew to determine from the appearance of the lubrication oil whether water has made its way into it and, if so, what proportion of water there is in the lubrication oil.

The lubrication oil is fed into and drained away from the ship's drive in the area of the upper drive unit, in which at least one venting duct that can be closed off is also provided for letting air out of the oil-carrying spaces of the ship drive.

A further feature of the invention is that the aforesaid flexible line to the lubricant container is connected to the free end of a lubrication oil duct formed in the wall of the gearbox housing of the upper drive unit. Preferably, this lubrication oil duct in the gearbox housing is connected at its other end to a lubrication oil duct in the wall of a supporting structure of the upper drive unit, which leads in the direction of the vertical driveshaft and the lower drive unit. As will be made clear with reference to an example embodiment the gearbox housing and the supporting structure are connected solidly to one another so that the supporting structure carries the gearbox housing and other components of the upper drive unit.

As regards the sealable venting duct, it can be provided that this is formed in the wall of the supporting structure of the upper drive unit.

In addition, it is a feature of a ship's drive according to the invention that within the supporting structure of the upper drive unit there is arranged a hollow cylindrical hub that can be rotated by an electric motor, which is connected solidly to a hollow supporting fin of the lower drive unit. The vertical driveshaft mentioned earlier, which provides the driving connection between the upper drive unit and the lower drive unit, is accommodated coaxially in the hub and in the supporting fin, being mounted in these two components by means of roller bearings.

It is also advantageous, in the area of the supporting fin close to the hub, the fin being able to rotate relative to the ship's hull, to provide an oil collection space that forms a flow connection, via a rotary decoupling means, with the fixed lubrication oil duct in the wall of the supporting structure of the upper drive unit.

The rotary decoupling means can consist of a ring groove formed in the outer wall of a rotary plate connected to the supporting fin, the ring groove being sealed on the outside by sealing means (such as O-rings) and providing a flow connection between the lubrication oil duct in the wall of the supporting structure of the upper drive unit and the oil collection space in the area of the rotary or pivoting supporting fin or the rotary plate.

From the oil collection space, the lubrication oil passes along a lubricant path coaxial with the vertical driveshaft within the supporting fin, to the rotary components of the lower drive unit of the ship drive arranged underwater that require lubrication.

BRIEF DESCRIPTION OF THE DRAWINGS

The invention can be explained in more detail with reference to an example embodiment. For this purpose the description of a drawing is attached, which shows.

DETAILED DESCRIPTION OF THE PREFERRED EMBODIMENTS

Figure 1:
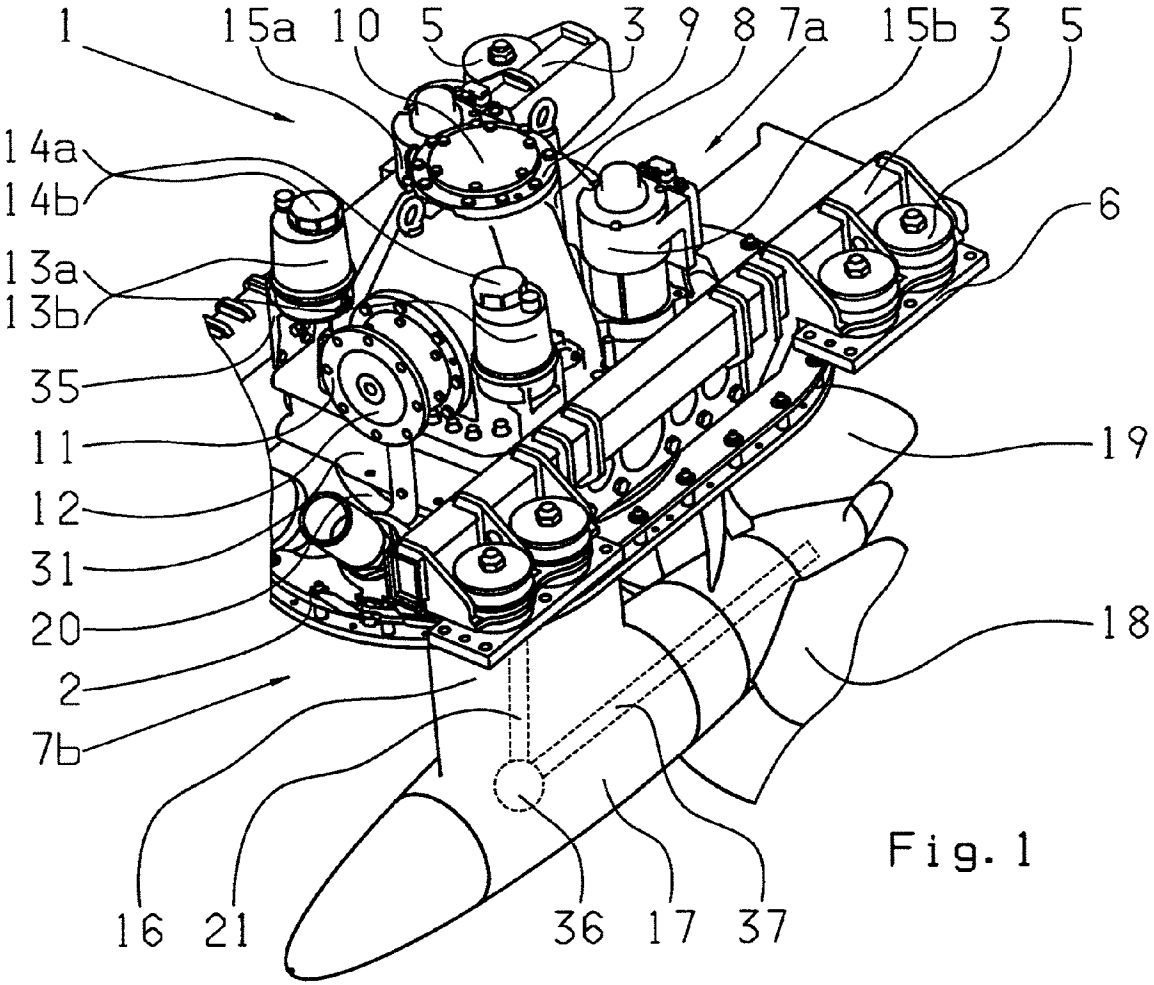
FIG. 1: A perspective representation of a ship drive with a fixed upper drive unit and a lower drive unit that can be pivoted relative thereto.

As shown, the ship drive 1 comprises an upper drive unit 7*a* arranged inside the ship's hull 39 and a lower drive unit 7*b* arranged outside the ship's hull, these being connected to one another. The lower drive unit 7*b* is mounted so that it can pivot relative to the ship's hull 39, so providing the ship with very high maneuverability.

The upper drive unit 7*a* has a supporting structure 31 that is connected solidly to a housing 8 of an upper bevel gear system 4. The supporting structure 31 is connected to two lateral struts 3, which are supported on the ship's hull 39 by vibration dampers 5 in the form of rubber-metal components and connecting pieces in the form of metal plates.

Onto the supporting structure 31 are fixed two electric motors 15*a*, 15*b*, which can drive a rotary hub 25 arranged radially within the supporting structure 31. This hub is solidly connected to a supporting fin 16 of the lower drive unit 7*b*, so that rotational movement of the hub 25 leads to rotational or pivoting movement of the supporting fin 16. At its end close to the hub, the supporting fin 16 has a rotary plate 20, which is held and able to rotate in a base structure 2 of the ship drive 1 connected to the ship's hull 39 and is sealed against any entry of water.

Furthermore, the ship drive 1 comprises an input shaft 12 arranged inside the ship's hull 39, which can be connected via a flange 11 and a clutch to the output shaft of a drive motor (not shown). The input shaft 12 extends through the gearbox housing 8 and is connected to the upper bevel gear system 4. For this purpose a spur bevel gear 23 is fixed to the input shaft 12, which meshes with a gearwheel 24. The gearwheel 24 is fixed to a driveshaft 21, which extends essentially vertically relative to the ship's hull 39 and passes coaxially through the gearbox housing 8, the supporting structure 31 and the supporting fin 16.

In the example embodiment illustrated the vertical driveshaft 21 is formed by more than one component, its axial sections being connected to one another in a rotationally fixed manner. At its upper end the driveshaft 21 is mounted in the gearbox housing 8 in a double-race upper roller bearing 22 comprising obliquely positioned cylindrical rollers. The housing 9 of this roller bearing 22 is inserted from above into a central opening in the gearbox housing 8 and there bolted to the latter. A cover 10 seals the upper side of the roller bearing 22 on the outside.

Figure 2:
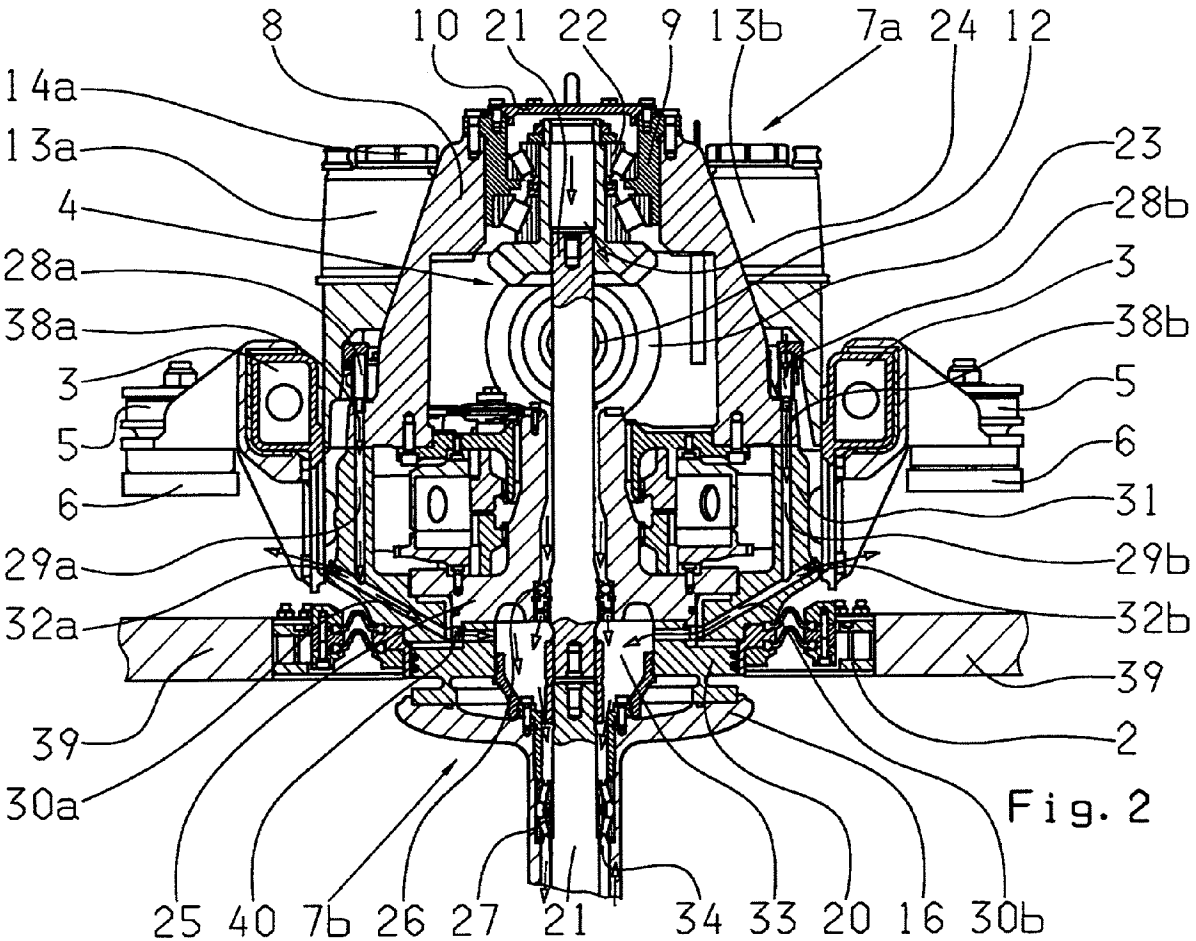
FIG. 2: A cross-section through the ship's drive shown in FIG. 1.

A central roller bearing 26, shown in FIG. 2, for mounting the vertical driveshaft 21 in the area of the upper drive unit 7*a* is arranged at the lower end of a hollow-cylindrical bore of the hub 25, whereas a lower roller bearing 27 for the driveshaft 21 is arranged at the upper end of a hollow-cylindrical bore in the supporting fin 16.

As shown in particular in FIG. 1, the underwater drive, i.e. the lower drive unit 7*b*, comprises a lower drive housing 17 orientated essentially parallel to the water surface. This drive housing 17 is connected to the supporting fin 16 and carries two propellers 18 and 19 that rotate in opposite directions. Broken lines are also used to represent the vertical driveshaft 21, which in the area of the lower drive housing 17 is in driving connection with lower bevel gear 36 represented only schematically. The lower bevel gear 36 drives an output shaft 37 also indicated with broken lines, which drives the two oppositely rotating propellers 18, 19 by means of a gear system (not shown) with a stage for rotation direction reversed.

Now that the overall structure of the ship drive 1 has been explained, the system for supplying and removing lubrication oil in the upper and lower drive units 7*a*, 7*b* will be described below.

The ship drive 1 according to the example embodiment in FIGS. 1 and 2 has two lubricant containers 13*a* and 13*b*, each with a screw-on cover 14*a*, 14*b* which enables the lubricant containers 13*a*, 13*b* to be topped up with fresh lubrication oil. The respective lower portions of the lubrication oil containers 13*a*, 13*b* are held securely in pot-like sections of angled holders 35. These holders 35, made from a sheet material, are fixed with their angled sections each, respectively, on one of the two lateral struts 31 of the ship drive 1, i.e. they are not connected directly to the gearbox housing 8 or the supporting structure 31.

For the supply of lubrication oil to the upper and lower drive units 7*a*, 7*b*, the two lubrication oil containers 13, 13*b* are in each case connected, with vibration decoupling by means of a flexible line 28*a*, 28*b*, to the respective upwardly-projecting free ends of lubrication oil ducts 38*a*, 38*b* in the gearbox housing 8 of the upper drive unit 7*a*. The flexible lines 28*a*, 28*b* can be in the form of flexible plastic lines sheathed with wire mesh, or of transparent flexible plastic lines.

In the example embodiment chosen here, beyond the lubrication oil ducts 38*a*, 38*b* in the gearbox housing 8 further lubrication oil ducts 29*a*, 29*b* are formed in the outer wall of the supporting structure 31 of the upper drive unit 7*a*, which after a short vertical stretch, in each case open into lubrication oil ducts 30*a*, 30*b* that lead downward in the direction toward the lower drive unit 7*b* and radially inward. From the oblique lubrication oil ducts 30*a*, 30*b* just mentioned, in each case there branches off a venting duct 32*a*, 32*b* that can be sealed by a closing screw or a plug, through which air can escape out into the atmosphere from the oil-carrying spaces of the ship drive 1 during a lubrication oil filling process. These venting ducts 32*a*, 32*b* can also be used during an oil change to flush used lubrication oil out of the ship drive 1 by a rinsing process.

The lower ends of the lubrication oil ducts 30*a* and 30*b* open into a radially outer ring groove 40 formed in an outer wall of the rotary plate 20 of the lower drive unit 7*b* close to the hub, which (i.e. 40) enables a rotary decoupling of the lubrication oil system between the rotationally fixed components 8, 31 of the upper drive unit 7*a* and the rotatable or pivotable components 16, 17, 18, 19, 20 of the lower drive unit 7*b*. From the ring groove 40 in the rotary plate 20, the lubrication oil passes through the outer wall of the rotary plate 20 into an oil collection space 33 formed radially on the inside, from which the lubrication oil runs essentially vertically downward into the lubricating oil duct 34 in the supporting fin 16. There, the lubrication oil serves to lubricate the lower, three-race cylindrical roller bearing 27 which holds the driveshaft 21 in the upper portion of the supporting fin 16. As shown by the direction arrows in FIG. 2, the oil collection space 33 also holds lubrication oil that runs down from the upper roller bearing 22 and the upper bevel gear gearing.

Furthermore, the otherwise directed arrows in the area of the lubricating oil ducts and the venting ducts illustrate the paths that the lubricating oil and air can take during a filling process or a draining process. These show that after passing through the lower, three-race cylindrical roller bearing 27 the lubrication oil runs into the lubrication oil duct 34 of the supporting fin 16 and on, vertically downward, into the lower drive housing 17 and to the second bevel gear system 36. From there the lubrication oil flows, via further bearing points, to the mounting of the output shaft 37 and to the gear system (not shown) with the rotation direction reversal stage and the roller bearings of the two oppositely rotating propellers 18 and 19.

The lubrication oil guideways are preferably designed so that a continuous circulation of the lubrication oil takes place in the lubrication oil system of the ship's drive 1 as described. For this purpose a lubrication oil pump is provided, by means of which the lubrication oil can also be delivered to the upper bevel gear 4, the upper roller bearing 22 and the bearing points of the rotation or pivoting drive for the lower drive unit 7*b*. This lubrication oil pump also facilitates the simple exchange of old lubrication oil for new.

INDEXES

1 Ship drive
2 Base structure
3 Lateral strut
4 Upper bevel gear
5 Vibration damper
6 Connecting piece
7*a* Upper drive unit
7*b* Lower drive unit
8 Transmission housing of the upper drive unit
9 Bearing housing
10 Cover of the bearing housing
11 Flange
12 Input shaft
13*a* Lubrication oil container
13*b* Lubrication oil container
14*a* Cover of the lubrication oil container
14*b* Cover of the lubrication oil container
15*a* Electric motor
15*b* Electric motor
16 Supporting fin
17 Lower drive housing
18 Propeller
19 Propeller
20 Rotary plate
21 Driveshaft
22 Upper roller bearing
23 Spur bevel gear
24 Gearwheel
25 Rotary hub
26 Central roller bearing
27 Lower roller bearing
28*a* Lubrication oil duct in the supporting structure 31
29*b* Lubrication oil duct in the supporting structure 31
30*a* Lubrication oil duct in the supporting structure 31
30*b* Lubrication oil duct in the supporting structure 31
31 Supporting structure for the upper drive unit
32*a* Venting duct in the supporting structure 31
32*b* Venting duct in the supporting structure 31
33 Oil collection space
34 Lubrication oil duct in the supporting fin
35 Holder for the oil container
36 Lower bevel gear
37 Output shaft
38*a* Lubrication oil duct in the gearbox housing
38*b* Lubrication oil duct in the gearbox housing
39 Ship's hull
40 Ring groove in the rotary plate 20

The invention claimed is:

1. A ship drive (1) comprising an upper drive unit (7*a*) being arranged in a ship hull (39) and a lower drive unit (7*b*) being arranged outside the ship hull;

at least the lower drive unit (7*b*) being pivotably mounted relative to the ship hull (39);

an input shaft (12) of the upper drive unit (7*a*) being drivable by a drive motor;

at least one propeller (18, 19) being drivable by an output shaft (37) arranged in the lower drive unit (7*b*);

a vertically arranged driveshaft (21) being in driving connection, via an upper bevel gear (4), with the input shaft (12) of the upper drive unit (7*a*) and, via a lower bevel gear (36), with the output shaft (37) of the lower drive unit (7*b*);

the upper and the lower drive units (7*a*, 7*b*) comprising interconnected lubrication oil ducts for directing lubrication oil to and from the upper drive unit (7*a*), and at least one lubrication oil duct (29*a*, 29*b*) of the upper drive unit (7*a*) being connected, by a flexible line (28*a*, 28*b*), to a lubrication oil container (13*a*, 13*b*) arranged in an area of the upper drive unit (7*a*); and the at least one lubrication oil duct (29*a*, 29*b*) of the upper drive unit (7*a*) being substantially vertically oriented and being spaced from the driveshaft (21).

2. The ship drive according to claim 1, wherein at least one lubrication oil container (13*a*, 13*b*) is arranged at a distance away from a gearbox housing (8) of the upper bevel gear (4).

3. The ship drive according to claim 1, wherein at least one lubrication oil container (13*a*, 13*b*) is spaced from a gearbox housing (8) of the upper bevel gear (4) and located on a lateral strut (3) of the ship drive (1).

4. The ship drive according to claim 3, wherein at least one closable venting duct (32*a*, 32*b*) is formed in the upper drive unit (7*a*).

5. A ship drive (1) comprising an upper drive unit (7*a*) being arranged in a ship hull (39) and a lower drive unit (7*b*) being arranged outside the ship hull;

at least the lower drive unit (7*b*) being pivotably mounted relative to the ship hull (39);

an input shaft (12) of the upper drive unit (7*a*) being drivable by a drive motor;

at least one propeller (18, 19) being drivable by an output shaft (37) arranged in the lower drive unit (7*b*);

a vertically arranged driveshaft (21) being in driving connection, via an upper bevel gear (4), with the input shaft (12) of the upper drive unit (7*a*) and, via a lower bevel gear (36), with the output shaft (37) of the lower drive unit (7*b*);

the upper and the lower drive units (7*a*, 7*b*) comprising interconnected lubrication oil ducts for directing lubrication oil to and from the upper drive unit (7*a*), and at least one lubrication oil duct (29*a*, 29*b*) of the upper drive unit (7*a*) being connected, by a flexible line (28*a*, 28*b*), to a lubrication oil container (13*a*, 13*b*) arranged in an area of the upper drive unit (7*a*); and the flexible line (28*a*, 28*b*) is connected to a free end of another lubrication oil duct (38*a*, 38*b*) formed in a wall of a gearbox housing (8) of the upper drive unit (7*a*).

6. The ship drive according to claim 5, wherein the lubrication oil duct (38*a*, 38*b*) in the gearbox housing (8) is connected to the lubrication oil duct (29*a*, 29*b*) in a wall of a supporting structure (31) of the upper drive unit (7*a*), and the lubrication oil duct (29*a*, 29*b*) in the supporting structure (31) extends toward the vertical driveshaft (21) and the lower drive unit (7*b*).

7. The ship drive according to claim 6, wherein a hollow-cylindrical hub (25) that is rotatable by at least one electric motor (15*a*, 15*b*), which is connected solidly to a hollow supporting fin (16) of the lower drive unit (7*b*), is arranged inside the supporting structure (31) of the upper drive unit (7*a*).

8. The ship drive according to claim 7, wherein the vertical driveshaft (21) is coaxially with respect to the hub (25) and the supporting fin (16) and is mounted therein by a bearing (26, 27).

9. A ship drive (1) comprising an upper drive unit (7*a*) being arranged in a ship hull (39) and a lower drive unit (7*b*) being arranged outside the ship hull;

at least the lower drive unit (7*b*) being pivotably mounted relative to the ship hull (39);

an input shaft (12) of the upper drive unit (7*a*) being drivable by a drive motor;

at least one propeller (18, 19) being drivable by an output shaft (37) arranged in the lower drive unit (7*b*);

a vertically arranged driveshaft (21) being in driving connection, via an upper bevel gear (4), with the input shaft (12) of the upper drive unit (7*a*) and, via a lower bevel gear (36), with the output shaft (37) of the lower drive unit (7*b*);

the upper and the lower drive units (7*a*, 7*b*) comprising interconnected lubrication oil ducts for directing lubrication oil to and from the upper drive unit (7*a*), and at least one lubrication oil duct (29*a*, 29*b*) of the upper drive unit (7*a*) being connected, by a flexible line (28*a*, 28*b*), to a lubrication oil container (13*a*, 13*b*) arranged in an area of the upper drive unit (7*a*); and in an area adjacent to a hub of a supporting fin (16), that is rotatable relative to a ship hull (39), an oil collection space (33) is formed which is in flow connection, via a rotation decoupling means, with at least one fixed lubrication oil duct (30*a*, 30*b*) in a wall of a supporting structure (31) of the upper drive unit (7*a*).

10. The ship drive according to claim 9, wherein the rotation decoupling means comprises a ring groove (40) formed on an outer wall of a rotary plate (20) connected to the supporting fin (16) such that the ring groove (40) is sealed, on an outside, and is in flow connection both with the lubrication oil duct (30*a*, 30*b*) in the wall of the supporting structure (31) of the upper drive unit (7*a*), and also with the oil collection space (33) in one of an upper area of the rotating supporting fin (16) or the rotary plate (20) of the lower drive unit (7*b*).

11. The ship drive according to claim 6, wherein a venting duct (32*a*, 32*b*) is formed in the wall of the supporting structure (31).

12. The ship drive according to claim 1, wherein a bottom end of the at least one lubrication oil duct (29*a*, 29*b*) of the upper drive unit (7*a*) directly connects with a radially inwardly oriented oblique lubrication oil duct (30*a*, 30*b*).

13. The ship drive according to claim 1, wherein the at least one lubrication oil duct (29*a*, 29*b*) of the upper drive unit (7*a*) connects to the flexible line (28*a*, 28*b*) via another substantially vertically oriented lubrication oil duct (38*a*, 38*b*) formed in a gearbox housing (8) of the upper drive unit (7*a*).

14. The ship drive according to claim 1, wherein the at least one lubrication oil duct (29*a*, 29*b*) is formed in an outer wall of a supporting structure (31) of the upper drive unit (7*a*), and the at least one lubrication oil duct (29*a*, 29*b*) communicates with at least one downward and radially inward lubrication oil duct (30*a*, 30*b*) which leads toward the lower drive unit (7*b*).

15. The ship drive according to claim 14, wherein a venting duct (32*a*, 32*b*) communicates with the at least one downward and radially inward lubrication oil duct (30*a*, 30*b*) that leads toward the lower drive unit (7*b*), and the venting duct (32*a*, 32*b*) and air can escape to atmosphere during a lubrication oil filling process.

* * * * *